US008149118B2

(12) United States Patent
Niesen et al.

(10) Patent No.: US 8,149,118 B2
(45) Date of Patent: Apr. 3, 2012

(54) DEVICE AND METHOD FOR REGISTERING THE OPENING OF CLOSURES OF SPACES TO BE SECURED

(75) Inventors: Klaus Niesen, Bad Toelz (DE); Hubert Kalweit, Kirchseeon (DE)

(73) Assignee: Robert Bosch GmbH, Stuttgart (DE)

( * ) Notice: Subject to any disclaimer, the term of this patent is extended or adjusted under 35 U.S.C. 154(b) by 623 days.

(21) Appl. No.: 10/590,049

(22) PCT Filed: Dec. 27, 2005

(86) PCT No.: PCT/EP2005/057180

§ 371 (c)(1),
(2), (4) Date: Aug. 21, 2006

(87) PCT Pub. No.: WO2006/074861

PCT Pub. Date: Jul. 20, 2006

(65) Prior Publication Data

US 2008/0191870 A1 Aug. 14, 2008

(30) Foreign Application Priority Data

Jan. 13, 2005 (DE) ..... 10 2005 001 582

(51) Int. Cl.
*G08B 13/08* (2006.01)

(52) U.S. Cl. ..... 340/545.2; 340/539.22; 340/539.1; 340/547; 340/572.1

(58) Field of Classification Search ..... 340/545.1, 340/545.6, 572.1, 572.3, 572.7, 540, 541, 340/568.1, 545.2, 539.22, 539.23, 539.26, 340/3.5, 3.51

See application file for complete search history.

(56) References Cited

U.S. PATENT DOCUMENTS

| | | | | |
|---|---|---|---|---|
| 4,092,642 | A * | 5/1978 | Green et al. | 340/527 |
| 4,262,284 | A * | 4/1981 | Stieff et al. | 340/541 |
| 4,750,197 | A | 6/1988 | Denekamp et al. | |
| 4,924,417 | A * | 5/1990 | Yuasa | 340/506 |
| 5,189,396 | A | 2/1993 | Stobbe | |
| 5,515,030 | A | 5/1996 | Citron et al. | |
| 6,069,563 | A | 5/2000 | Kadner et al. | |
| 6,097,306 | A | 8/2000 | Leon et al. | |
| 6,317,025 | B1 | 11/2001 | Leon et al. | |
| 6,747,558 | B1 * | 6/2004 | Thorne et al. | 340/551 |
| 7,053,823 | B2 * | 5/2006 | Cervinka et al. | 342/357.31 |
| 7,057,512 | B2 * | 6/2006 | Stilp | 340/572.1 |
| 7,091,827 | B2 * | 8/2006 | Stilp | 340/10.1 |
| 7,113,093 | B2 * | 9/2006 | Fallin et al. | 340/572.1 |

(Continued)

FOREIGN PATENT DOCUMENTS

| | | |
|---|---|---|
| DE | 40 19 265 | 11/1991 |

(Continued)

*Primary Examiner* — George Bugg
*Assistant Examiner* — Anne Lai
(74) *Attorney, Agent, or Firm* — Michael J. Striker

(57) ABSTRACT

In a device and a method for registering the opening of closures of spaces to be secured, a sealing module, which includes a sensor, a microprocessor, a memory, and a wireless communication device, can be attached to the closure in such a way that the sensor detects a movement and writes data documenting the movement into the memory; a detection unit includes at least one wireless communication device, a microprocessor, and a memory that are embodied to read out at least the data documenting the movement from the memory of the sealing module and to write these data into the memory of the mobile detection unit.

22 Claims, 2 Drawing Sheets

U.S. PATENT DOCUMENTS

| | | | | |
|---|---|---|---|---|
| 7,135,976 | B2 * | 11/2006 | Neff et al. | 340/572.1 |
| 7,145,454 | B2 * | 12/2006 | Linjama et al. | 340/540 |
| 7,196,622 | B2 * | 3/2007 | Lambright et al. | 340/539.26 |
| 7,333,015 | B2 * | 2/2008 | Ekstrom | 340/545.6 |
| 2002/0061758 | A1 * | 5/2002 | Zarlengo et al. | 455/517 |
| 2003/0164763 | A1 * | 9/2003 | Hisano et al. | 340/539.13 |
| 2004/0041705 | A1 | 3/2004 | Auerbach | |
| 2004/0100379 | A1 | 5/2004 | Boman et al. | |
| 2004/0113783 | A1 * | 6/2004 | Yagesh | 340/568.1 |
| 2004/0227630 | A1 * | 11/2004 | Shannon et al. | 340/539.22 |
| 2004/0233054 | A1 * | 11/2004 | Neff et al. | 340/539.1 |
| 2004/0263332 | A1 * | 12/2004 | Maple et al. | 340/545.1 |
| 2005/0099292 | A1 * | 5/2005 | Sajkowsky | 340/539.13 |
| 2007/0194914 | A1 * | 8/2007 | Gates | 340/541 |

FOREIGN PATENT DOCUMENTS

| | | |
|---|---|---|
| EP | 0 955 616 | 11/1999 |

* cited by examiner

DEVICE AND METHOD FOR REGISTERING THE OPENING OF CLOSURES OF SPACES TO BE SECURED

The present invention relates to a device and method for registering the opening of closures of spaces to be secured.

PRIOR ART

Lead seals and other seals that are destroyed when opened and as a rule cannot be reconstituted without leaving perceptible traces are used to prevent the unauthorized opening of closures—in particular doors.

Thus, for example, aircraft that are parked in the apron area or at the gate ready for the next flight must, after the end of service work, be monitored in accordance with applicable regulations to make sure that no unauthorized person enters the aircraft. Before the maintenance personnel, suppliers, or cleaning crew board an aircraft, authorized personnel must check whether an unauthorized opening has occurred. To that end, after maintenance work, the related openings (doors) are provided with paper and glue seals. Before the doors are reopened, these seals are checked to make sure that they are intact.

This method, however, has various problems and disadvantages. For example, paper seals can come off due to environmental influences such as rain or stormy weather, or be damaged by the movements of the aircraft itself. Moreover, the method suffers from gaps and is inconsistent. It is also disadvantageous that unauthorized persons could gain access to the paper seals. There is no inventory and as a rule, documentation is incomplete.

When a seal is damaged, it is impossible to determine what caused the damage and when the damage occurred. There is no way to assure a correct management of the paper seals since these seals come in blank form and are individually written on by hand when the aircraft is sealed. Consequently, it is not at present easy to determine whether a damaged seal has been subsequently replaced.

The object of the present invention is to permit an improved monitoring of sealed closures.

ADVANTAGES OF THE INVENTION

This object is attained with the device according to the present invention in that a sealing module, which includes a sensor, a microprocessor, a memory, and a wireless communication device, can be attached to the closure in such a way that the sensor detects a movement and writes data documenting the movement into the memory; a detection unit includes at least one wireless communication device, a microprocessor, and a memory that are embodied to read out at least the data documenting the movement from the memory of the sealing module and write these data into the memory of the detection unit.

The device according to the present invention is suitable for all openings that can be secured with closures, in particular doors, flaps, covers, and screw closures: aside from the above-mentioned aircraft doors, other applications include, for example, receptacle openings of hazardous materials transporters and tanker vehicles, openings of containers for valuables and classified documents, and access openings to storage spaces and receptacles for explosives and munitions. The sealing module can be attached using contact adhesives, magnets, clips, and other means.

In a sealing module that is as small as possible and is intended to be attached anywhere, for the sake of low energy consumption, it is preferable for the wireless communication devices to be effective at close range and for the detection unit to be mobile. If the wireless communication devices are RFID components, then this enables a particularly compact, inexpensive embodiment of the device according to the present invention. The communication occurs passively, i.e. the required energy is drawn from the received antenna energy.

If individual conditions also permit wireless communication over larger distances, then the present invention can also be embodied so that the detection unit is stationary.

The structural embodiment of the sealing module can be adapted to the requirements of the respective use. One advantageous embodiment makes the device according to the invention particularly easy to use and store in that the sealing module is embodied in the form of an ID01-format card. It is also possible to select more compact embodiment forms, for example block-shaped or cylindrical forms; the sealing module can be protected by being encapsulated in plastic. In addition, the sealing module can be integrated into the closures to be secured, for example doors, flaps, and covers, or into closing elements such as locking mechanisms and clamping elements.

After the attachment of the sealing module to the corresponding closure, the sealing module is activated through a communication with the detection unit. In order to prevent misuse in both this and subsequent communications, one modification of the present invention provides for an encrypted communication between the sealing module and detection unit.

In another modification, the sealing module has an optical display unit for indicating the current status. This can, for example, be embodied so that an LED indicates whether the sealing module has been moved since being activated or so that more precise information is displayed with the aid of an LCD display.

With the present invention, the sensor can be a position sensor. Other types of sensors, however, can also be used as the sensor. In addition to a position sensor, which is attached to a door or cover, for example, and detects a movement of the door or cover, other types of sensors can also be used depending on the individual circumstances. For example, a sensor can be used, which generates a signal as a function of its distance from a part in the vicinity; the part can be attached to the door and the sensor can be attached to a stationary part or vice versa. In addition, the sensor can be a magnetic sensor, for example.

Another advantageous embodiment is comprised in that the data that document a movement are provided with a timestamp. It is thus possible to document not only the fact that an unauthorized opening has occurred, but also when it occurred.

With the device according to the present invention, the detection unit is preferably able to write data regarding the respective location of use into the memory of the sealing module and read out said data from the memory. This also further improves the documentation so that after the sealing module is checked, the detection unit has precise information about whether, when, and where an unauthorized opening has occurred.

In order to assure uninterrupted registration and proper operation of the device according to the invention, in an advantageous embodiment, the detection unit has a program that displays the stored data regarding closures of a secured object on a screen and, with the aid of a menu, predefines a sequential check of the associated sealing modules, correspondingly displaying on the screen the sealing modules currently being checked.

Finally, in another advantageous embodiment, the detection unit includes means for connecting to a database, which stores all sealing and unsealing actions as well as all information regarding the opening of sealed closures. In larger systems in which it is possible to operate a multitude of mobile detection units, the database, which as a rule is part of a computer, is capable of storing all data regarding sealing and unsealing actions as well as the opening of sealed closures over larger spans of time. These data are then available, for example, for verification purposes.

The method according to the invention attains the stated object in that when the closure is opened, a signal of a sensor is written into a memory that is situated together with the sensor at the closure and in that subsequently, the content of the memory is read out via a wireless communication, stored in a detection unit, and displayed. Preferably, the wireless communication occurs by means of the RFID method.

One advantageous embodiment of the method according to the present invention is comprised in that after a sealing module, which includes the memory and the sensor, is attached to the closure, the sealing module is activated by means of a wireless communication from the detection unit. In addition, the time of the opening can be documented by associating the signal of the sensor with a timestamp in the memory. It is also possible to document the sealing time in the memory of the sealing module and/or detection unit.

It is therefore possible, regardless of whether or not the operator is paying scrupulous attention, for a plurality of closures to be registered by virtue of the fact that a program provided in the detection unit predetermines the attachment, the activation, and the reading out from the memory of a plurality of sealing modules. For documentation purposes, the contents of the memories of the sealing modules can be transmitted into a database.

DRAWINGS

Exemplary embodiments of the present invention are shown in several figures in the drawings and will be explained in detail in the description that follows.

DESCRIPTION OF THE EXEMPLARY EMBODIMENTS

Figure 1:
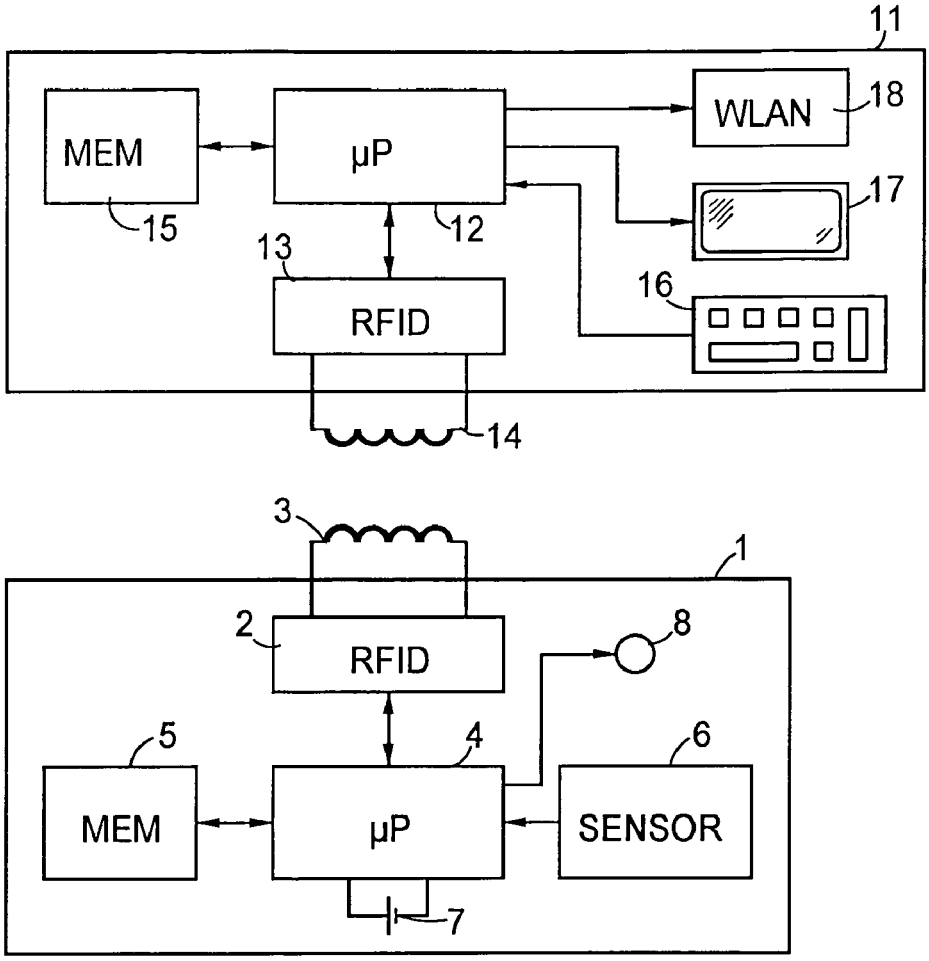
FIG. 1 shows a sealing module and a detection unit.

FIG. 1 shows block circuit diagrams of a sealing module 1 and a mobile detection unit 11. The sealing module 1 contains an RFID unit 2 with an antenna coil 3, a microprocessor 4, a memory 5, and a position sensor 6 as well as a battery 7, which is an integrated gel battery when an ID01 card is used. In addition, the microprocessor 4 is connected to an optical display unit 8 that lights up, for example, when the sensor 6 has detected a movement.

The mobile detection unit 11 likewise contains a microprocessor 12 and, for communication with the sealing module 1, an RFID unit 13 and an antenna coil 14. The microprocessor is connected to a memory 15, an input unit 16, a screen (display) 17, and an interface 18. The latter can serve to send and receive data to and from a database or central computer. In a manner that is not shown, the mobile detection unit 11 can be supplied with power by means of a rechargeable battery, as is common in other mobile devices. The input unit 16 can be used to enter commands, data, and if necessary, a PIN code of the respective user.

Figure 2:
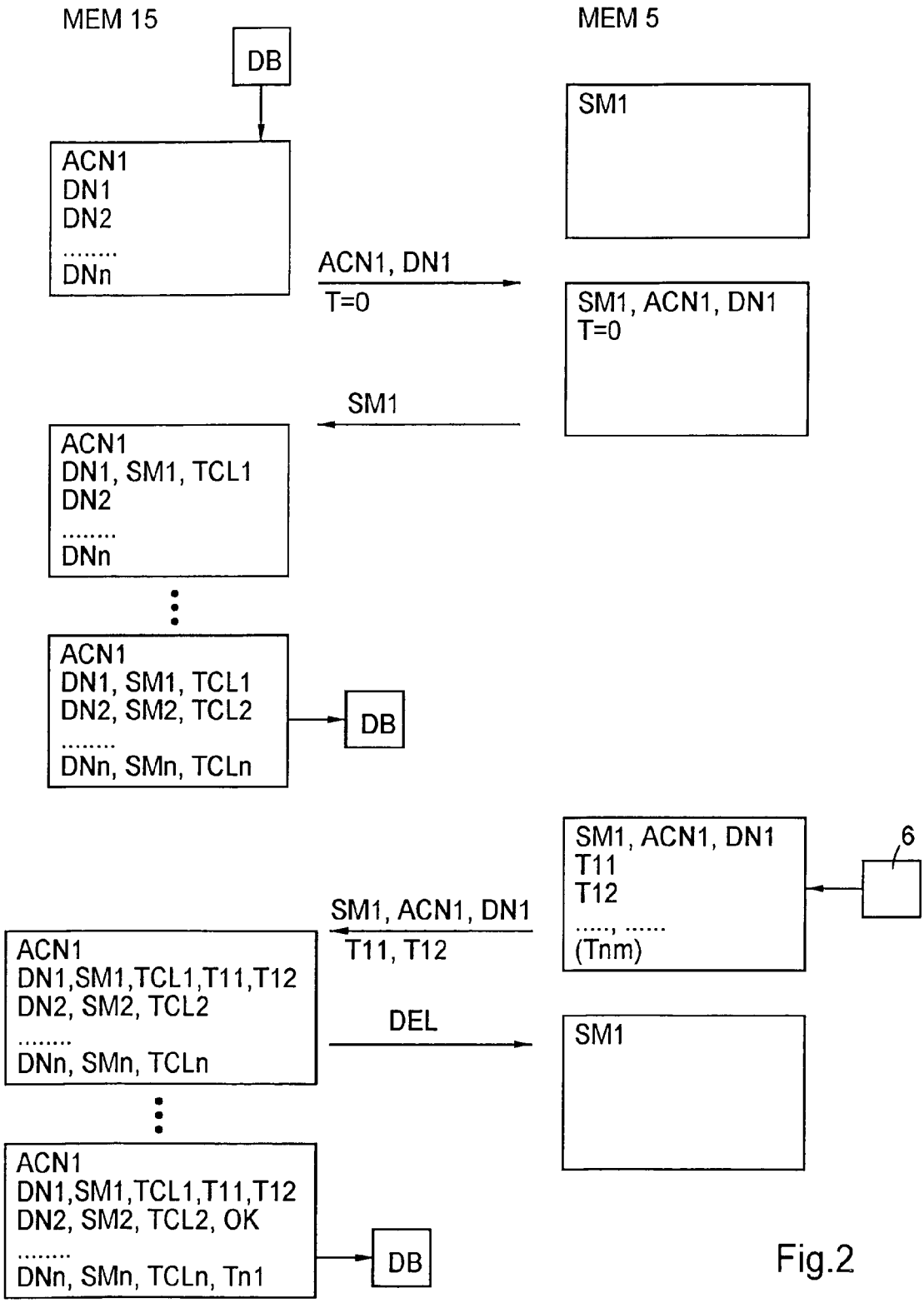
FIG. 2 is a schematic depiction of the sequence of an exemplary embodiment of the method according to the present invention.

The left column in FIG. 2 shows the contents of the memory 15 of the mobile detection unit 11, the right column shows the contents of the memory 5 of the sealing module 1 and between them appear the data respectively transmitted, provided that they are required for explanation of the method according to the present invention. The drawing also does not show an intrinsically suitable encryption of the data to be exchanged and a reciprocal authentication of the sealing module and the mobile detection unit. Suitable cryptographic methods are known, for example, for the communication between bank cards and terminals.

In the exemplary embodiment shown, it has been assumed that the memory 5 of the sealing module contains only one invariable identification of the respective sealing module, for example the sealing module SM1. The doors DN1 through DNn of an aircraft ACN1 to be sealed have been written into the memory 15 of the mobile detection unit in a sequence for sealing of the individual doors, for example via the interface 18 from a database DB. In accordance with this instruction, the sealing module with the identification SM1 is attached to the door DN1 of the aircraft with the number ACN1 (the coordination in the numbering here is coincidental).

After the attachment of the sealing module and the approach of the antennae 3, 14 (FIG. 1), a command for data transmission to the sealing module is input into the mobile detection unit via the input unit 16. These data include the number of the aircraft ACN1 and the number of the door DN1 as well as a command to reset the timer contained in the sealing module to zero and start the timer. As an acknowledgment, the sealing module transmits its identification SM1 to the mobile detection unit, in which it is added to the door number DN1.

The time TCL1 at which the door with the door number DN1 was sealed is also stored. The doors DN2 through DNn are sealed in the same way until the table contained in the memory 15 is complete and is transmitted to a database DB. If the microprocessor 4 (FIG. 1) receives a message from the position sensor 6, then it inputs this into the memory 5 with a time T1 at which the timer was started. If need be, other messages B2 through Bn can also be stored in the memory 5.

For checking or unsealing, the mobile detection unit is reconnected to the sealing module, whereupon the sealing module transmits its identification SM1, the aircraft number ACN1, and the door number DN1, as well as any messages that are present, along with their times T1 through Tn. For the sake of security, a message OK can be transmitted, which signifies that there are no messages in the memory 5. This terminates the checking of the sealing module with the identification SM1. If an unsealing is to be executed at this point, then a command DEL can be sent to the sealing module in order to delete all of the changeable data in the memory of the sealing module so that the sealing module can be removed and reused. If the sealing modules of the doors DN1 through DNn are checked and unsealed, then all of the data are sent to the database DB for further processing or for documentation.

The sequence depicted is intended merely as an example of the method according to present invention and can be adapted as needed by those skilled in the art. Thus, for example, the entire process of sealing, checking, and unlocking can be carried out in the detection unit and only then, the data can be transmitted to the database for documentation purposes.

What is claimed is:

1. A device for monitoring door sealing of a closure having a predetermined quantity of N doors, where N is an integer variable, comprising:

at least N sealing modules (1), wherein each sealing module (1) includes a sensor (6), a first microprocessor (4), a first memory (5), and a first wireless communication device (2, 3), and is configured to be attached to a respective one of the N doors in such a way that the sensor (6) detects a movement of the specific door and outputs movement data of the movement, which movement data is written into the first memory (5);

a detection unit (11) having at least one second wireless communication device (13, 14) for communication with the at least N sealing modules (1), a second microprocessor (12), and a second memory (15), the second microprocessor reading out at least the movement data from the first memory (5) and writing the movement data into the second memory (15); and a WLAN (wireless local area network) interface (18) disposed in the detection unit (11), the WLAN interface (18) sending and receiving data including the movement data to and from at least one of a database and a central computer by WLAN technology;

wherein the detection unit (11) is configured to check movement data recorded in any of the at least N sealing modules, in a menu-controlled predefined sequence, and correspondingly displaying a checking status.

2. The device as recited in claim 1, wherein the wireless communication devices (2, 3; 13, 14) are effective at close range and the detection unit (11) is mobile.

3. The device as recited in claim 2, wherein the wireless communication devices (2, 3; 13, 14) are RFID components.

4. The device as recited in claim 1, wherein the detection unit (11) is stationary.

5. The device as recited in claim 1, wherein the sealing module (1) is embodied in the form of an ID01-format card.

6. The device as recited in claim 1, wherein the sealing module (1) is integrated into the closure.

7. The device as recited in claim 1, wherein the sealing module (1) is integrated into a closing element that secures the closure.

8. The device as recited in claim 1, wherein an encrypted communication is provided between the sealing module (1) and the detection unit (11).

9. The device as recited in claim 1, wherein the sealing module (1) has an optical display unit (8) for indicating the current status.

10. The device as recited in claim 1, wherein the sensor (6) is a magnetic sensor.

11. The device as recited in claim 1, wherein the data that document a movement are provided with a timestamp.

12. The device as recited in claim 1, wherein the detection unit (11) is configured to write data regarding the respective location of use into the first memory (5) and read out said data from the first memory (5).

13. The device as recited in claim 1, wherein the detection unit (11) has a program that displays the stored data regarding a secured object on a screen (17) and, with the aid of a menu, predefines a sequential check of the associated sealing modules (1), correspondingly displaying on the screen (17) the respective sealing modules (1) being checked.

14. The device as recited in claim 1, wherein the detection unit (11) includes means (18) for connecting to a database (DB), which stores all sealing and unsealing actions as well as all information regarding the opening of sealed closures.

15. The device as recited in claim 1, wherein the closure includes an aircraft.

16. A method for monitoring sealing of a closure, which closure is arranged with a predetermined quantity of N doors and equipped with at least N sealing modules and where N is an integer variable, comprising the sequential steps of:

sensing an opening of a specific door of the N doors by a sensor disposed in a sealing module attached to the specific door and outputting opening data corresponding to the opening;

writing the opening data into a first memory disposed in the sealing module attached to the specific door;

reading out a content of the first memory via a wireless communication device stored in a detection unit;

writing the content into a second memory disposed in the detection unit;

checking opening data recorded in any of the N sealing modules in a menu-controlled sequence and correspondingly displaying a checking status on a display of the detection unit; and sending and receiving data including the content by WLAN (wireless local area network) technology to and from at least one of a database and a central computer via a WLAN interface disposed in the detection unit.

17. The method as recited in claim 16, further comprising providing the wireless communication device by RFID method.

18. The method as recited in claim 16, further comprising activating the sealing module by the wireless communication device from the detection unit.

19. The method as recited in claim 18, further comprising associating the opening data with a timestamp in the first memory.

20. The method as recited in claim 18, further comprising predetermining with a program provided in the detection unit an attachment, an activation, and a reading out from the memories of a plurality of sealing modules.

21. The method as recited in claim 20, further comprising transmitting the contents of the memories of the sealing modules into the database.

22. The method as recited in claim 16, wherein the closure includes an aircraft.

* * * * *